US012753761B2

(12) United States Patent
Mochizuki et al.

(10) Patent No.: US 12,753,761 B2
(45) Date of Patent: Oct. 6, 2026

(54) SCROLL-TYPE ELECTRIC COMPRESSOR

(71) Applicant: SANDEN CORPORATION, Gunma (JP)

(72) Inventors: Yuta Mochizuki, Isesaki (JP); Toshihiro Kasahara, Isesaki (JP); Takashi Kondo, Isesaki (JP); Masayuki Kigure, Isesaki (JP)

(73) Assignee: SANDEN CORPORATION, Gunma (JP)

( * ) Notice: Subject to any disclaimer, the term of this patent is extended or adjusted under 35 U.S.C. 154(b) by 0 days.

(21) Appl. No.: 19/118,932

(22) PCT Filed: Sep. 28, 2023

(86) PCT No.: PCT/JP2023/035327
§ 371 (c)(1),
(2) Date: Apr. 7, 2025

(87) PCT Pub. No.: WO2024/084913
PCT Pub. Date: Apr. 25, 2024

(65) Prior Publication Data

US 2026/0126044 A1 May 7, 2026

(30) Foreign Application Priority Data

Oct. 21, 2022 (JP) ..... 2022-168816

(51) Int. Cl.
*F04C 28/08* (2006.01)
*F04C 18/02* (2006.01)

(52) U.S. Cl.
CPC ..... *F04C 28/08* (2013.01); *F04C 18/0215* (2013.01); *F04C 18/0261* (2013.01);
(Continued)

(58) Field of Classification Search
CPC .. F04C 28/08; F04C 18/0215; F04C 18/0292; F04C 29/0085; F04C 2240/403; F04C 2240/81; F04C 2270/051; F04C 2270/72
See application file for complete search history.

(56) References Cited

U.S. PATENT DOCUMENTS 5,591,014 A 1/1997 Wallis et al.
5,782,610 A * 7/1998 Ikeda ..... F04C 18/0215 318/400.11

(Continued)

FOREIGN PATENT DOCUMENTS

JP H07-189945 A 7/1995
JP 2020-056322 A 4/2020
WO 2018/138860 A1 8/2018

OTHER PUBLICATIONS

International Search Report issued in PCT/JP2023/035327 mailed on Dec. 12, 2023.

*Primary Examiner* — Nathan C Zollinger
(74) *Attorney, Agent, or Firm* — Studebaker Brackett PLLC

(57) ABSTRACT

Provided is a scroll-type electric compressor capable of promptly decreasing pressure inside a scroll compression mechanism to smoothly and efficiently prevent reverse rotation and reduce noise when a motor is stopped. A control device 62 executes deceleration control of switching elements to decrease the rotation speed of a motor 2 after having received an instruction to stop the motor 2, and brake control of stopping a rotor 29 of the motor 2 at an angle at which a back pressure hole of a movable scroll is not closed or an angle at which a discharge hole of a fixed scroll is not closed after the rotation speed of the motor 2 has been decreased by the deceleration control and switching the switching elements 66A to 66F to fix the rotor at the angle.

6 Claims, 8 Drawing Sheets

(52) U.S. Cl.
CPC .... *F04C 2240/403* (2013.01); *F04C 2240/81* (2013.01); *F04C 2270/051* (2013.01); *F04C 2270/72* (2013.01)

(56) References Cited

U.S. PATENT DOCUMENTS

| | | | | |
|---|---|---|---|---|
| 6,042,344 | A * | 3/2000 | Lifson | F04C 28/28 417/310 |
| 6,719,545 | B2 * | 4/2004 | Lizuka | F04C 27/005 418/152 |
| 7,758,326 | B2 * | 7/2010 | Fujimura | F04C 27/005 418/55.1 |
| 10,436,194 | B2 * | 10/2019 | Nagata | F04C 14/06 |
| 11,933,298 | B2 * | 3/2024 | Teshima | F04C 27/005 |
| 2007/0231172 | A1 * | 10/2007 | Fujimura | F04C 18/0215 418/55.6 |
| 2012/0128518 | A1 * | 5/2012 | Yamada | F04C 18/0215 418/55.6 |
| 2015/0139818 | A1 * | 5/2015 | Nagata | F04C 28/06 417/45 |
| 2019/0345935 | A1 | 11/2019 | Ren et al. | |
| 2025/0172157 | A1 * | 5/2025 | Kawata | F04B 49/06 |

* cited by examiner

SCROLL-TYPE ELECTRIC COMPRESSOR

TECHNICAL FIELD

The present invention relates to a scroll-type electric compressor, and more particularly to control for preventing reverse rotation of a scroll compression mechanism and a rotor.

BACKGROUND ART

A scroll-type electric compressor includes a scroll compression mechanism having a fixed scroll with a spiral wrap on a face of an end plate and a movable scroll with a spiral wrap on a face of an end plate. The scroll-type electric compressor is configured such that a compression chamber is formed between the wraps of the scrolls by making these wraps face each other and the movable scroll is revolved relative to the fixed scroll by a motor and is moved from the outside to the inside while the volume of the compression chamber decreases. In this manner, the scroll-type electric compressor compresses working fluid (refrigerant).

In addition, the scroll-type electric compressor is integrally provided with an inverter device including a three-phase inverter circuit having a plurality of switching elements and a control device, and is driven by converting DC voltage from a DC power supply such as a battery into a three-phase AC voltage by switching the switching elements by the control device and applying the AC voltage to the motor.

When receiving an instruction to stop the motor from the outside, the control device stops the switching operation of the switching elements, and stops driving the motor. At this time, as the working fluid (refrigerant) remaining in the compression chamber expands, the movable scroll (and the rotor of the motor) rotates reversely due to a differential pressure between the discharge side and suction side of the scroll compression mechanism, and noise is generated from the scroll compression mechanism. For this reason, there has also been developed a technique of fixing a rotor by brake control using power generation braking when a motor is stopped to prevent such reverse rotation (see, for example, Patent Literature 1).

CITATION LIST

Patent Literature

Patent Literature 1: JP-A-2020-56322

SUMMARY OF INVENTION

Problems to be Solved by Invention

Here, FIG. 7 shows a sectional view of a movable scroll 100 and a fixed scroll 101 forming a general scroll compression mechanism. A wrap 103 is formed on a face of an end plate 102 of the movable scroll 100, and a wrap 106 is also formed on a face of an end plate 104 of the fixed scroll 101. A compression chamber 107 is formed between these wraps 103, 106.

A back pressure hole 108 is formed in the end plate 102 of the movable scroll 100. The back pressure hole 108 is a hole causing a back pressure chamber 109 on the back face side of the end plate 102 and the compression chamber 107 to communicate with each other, and plays a role of releasing pressure to the compression chamber 107 with an intermediate pressure when the pressure (back pressure) in the back pressure chamber 109 becomes excessive. However, when the motor is stopped, if the wrap 106 of the fixed scroll 101 closes the back pressure hole 108 as shown in FIG. 7, the pressure (refrigerant and oil) in the compression chamber 107 cannot be released through the back pressure hole 108 to the back pressure chamber 109, which leads to a delay in the pressure release. For this reason, there is a risk that the pressure remains in the compression chamber 107 of the scroll compression mechanism at the end of the brake control and reverse rotation starts to generate noise.

Thus, it is conceivable to extend the time for executing the brake control, but since power is distributed to the switching elements longer accordingly, problems such as failure and life shortening due to heat generation from the switching elements are caused this time.

The present invention has been made in order to solve these conventional technical problems, and is intended to provide a scroll-type electric compressor capable of promptly decreasing pressure inside a scroll compression mechanism to smoothly and efficiently prevent reverse rotation and reduce noise when a motor is stopped.

Solution to Problems

The scroll-type electric compressor according to the present invention includes a scroll compression mechanism including a movable scroll having a back pressure hole and a fixed scroll to compress working fluid, a motor that drives the movable scroll, an inverter circuit including a plurality of switching elements to drive the motor, and a control device that switches the switching elements, and the control device executes deceleration control of switching the switching elements to decrease the rotation speed of the motor after having received an instruction to stop the motor, and brake control of stopping a rotor of the motor at an angle at which the back pressure hole of the movable scroll is not closed or an angle at which a discharge hole of the fixed scroll is not closed after the rotation speed of the motor has been decreased by the deceleration control and switching the switching elements to fix the rotor at the angle.

In the above-described invention, in the scroll-type electric compressor of the invention of claim 2, the deceleration control executed by the control device includes sensorless deceleration control of decreasing the rotation speed of the motor by sensorless vector control after having received the instruction to stop the motor, and forced commutation deceleration control of decreasing the rotation speed of the motor to a predetermined low value by forced commutation control after the rotation speed of the motor has been decreased by the sensorless deceleration control.

In the above-described invention, in the scroll-type electric compressor of the invention of claim 3, the control device controls the value of a phase current in the forced commutation deceleration control and/or the brake control based on a phase current in the sensorless deceleration control or the pressure of the scroll compression mechanism.

In the invention of claim 1, in the scroll-type electric compressor of the invention of claim 4, the control device executes the brake control by electromagnetic braking before the rotation speed of the motor reaches zero, and feedback-controls the value of the phase current of the motor in the brake control.

In each of the above-described inventions, in the scroll-type electric compressor of the invention of claim 5, the control device detects the angle at which the back pressure hole or the discharge hole is not closed using at least one of a correlation between the phase current and the angle at which the back pressure hole or the discharge hole is not closed, a predetermined angle of the rotor, and a sensor that detects the angle of the rotor.

In the invention of claims 1 to 4, in the scroll-type electric compressor of the invention of claim 6, the scroll compression mechanism includes the fixed scroll and the movable scroll in which spiral wraps are formed on respective faces of end plates so as to face each other, and compresses the working fluid by causing the movable scroll to revolve relative to the fixed scroll and moving a compression chamber formed between the wraps of the scrolls while narrowing the compression chamber from the outside to the inside, the discharge hole causes a discharge chamber on the back face side of the end plate of the fixed scroll and the compression chamber to communicate with each other, and the back pressure hole causes a back pressure chamber on the back face side of the end plate of the movable scroll and the compression chamber to communicate with each other, and the angle at which the back pressure hole is not closed is an angle at which the wrap of the fixed scroll does not close the back pressure hole of the movable scroll when the rotor is stopped, and the angle at which the discharge hole is not closed is an angle at which the wrap of the movable scroll does not close the discharge hole of the fixed scroll when the rotor is stopped.

Effects of Invention

According to the present invention, in the scroll-type electric compressor including the scroll compression mechanism including the movable scroll having the back pressure hole and the fixed scroll to compress the working fluid, the motor that drives the movable scroll, the inverter circuit including the plurality of switching elements to drive the motor, and the control device that switches the switching elements, the control device executes the deceleration control of switching the switching elements to decrease the rotation speed of the motor after having received the instruction to stop the motor, and the brake control of stopping the rotor of the motor at the angle at which the back pressure hole of the movable scroll is not closed or the angle at which the discharge hole of the fixed scroll is not closed after the rotation speed of the motor has been decreased by the deceleration control and switching the switching elements to fix the rotor at the angle. Thus, when the motor is stopped, the rotor is fixed at the angle at which the wrap of the fixed scroll does not close the back pressure hole of the movable scroll or the angle at which the wrap of the movable scroll does not close the discharge hole of the fixed scroll as in the invention of claim 6.

As a result, the pressure inside the scroll compression mechanism can be promptly released and decreased through the back pressure hole of the movable scroll or the discharge hole of the fixed scroll. Thus, since the time for executing the brake control can also be shortened, it is possible to effectively prevent the reverse rotation of the movable scroll and reduce noise generated from the scroll compression mechanism while minimizing failure and life shortening due to heat generation from the switching elements.

In this case, as in the invention of claim 2, the control device executes, as the deceleration control executed by the control device, the sensorless deceleration control of decreasing the rotation speed of the motor by the sensorless vector control after having received the instruction to stop the motor, and the forced commutation deceleration control of decreasing the rotation speed of the motor to the predetermined low value by the forced commutation control after the rotation speed of the motor has been decreased by the sensorless deceleration control. Thus, the rotation speed of the motor can be promptly decreased by the sensorless deceleration control, and the rotation speed of the motor can be forcibly decreased by the forced commutation deceleration control in the range in which it is difficult to detect the position.

As in the invention of claim 3, the control device controls the value of the phase current in the forced commutation deceleration control and/or the brake control based on the phase current in the sensorless deceleration control or the pressure of the scroll compression mechanism. Thus, for example, when the value of the phase current in the sensorless deceleration control is small, the value of the phase current in the forced commutation deceleration control and the brake control is also decreased accordingly, or when the residual pressure of the scroll compression mechanism is low, the value of the phase current in the forced commutation deceleration control and the brake control is also decreased accordingly, so that the forced commutation deceleration control and the brake control can be executed stably and efficiently.

As in the invention of claim 4, since the control device executes the brake control before the rotation speed of the motor reaches zero, the angle at which the rotor is stopped and fixed can be accurately and easily adjusted to the angle at which the back pressure hole of the movable scroll is not closed. At that time, since electromagnetic braking is performed in the brake control and the value of the phase current of the motor is feedback-controlled, it is possible to prevent the phase current from excessively jumping up due to regenerative current which is concerned in conventional power generation braking and to avoid inconvenience leading to occurrence of failure of the element or the like in advance.

Note that as in the invention of claim 5, the angle at which the back pressure hole is not closed can be detected using the change in the amplitude of the phase current due to the torque pulsation, the predetermined angle of the rotor, the sensor that detects the angle of the rotor, or the like.

As in the invention of claim 6, as the details of the scroll compression mechanism, the scroll compression mechanism includes the fixed scroll and the movable scroll in which the spiral wraps are formed on the respective faces of the end plates so as to face each other, and compresses the working fluid by causing the movable scroll to revolve relative to the fixed scroll and moving the compression chamber formed between the wraps of the scrolls while narrowing the compression chamber from the outside to the inside, the discharge hole causes the discharge chamber on the back face side of the end plate of the fixed scroll and the compression chamber to communicate with each other, and the back pressure hole causes the back pressure chamber on the back face side of the end plate of the movable scroll and the compression chamber to communicate with each other, and the angle at which the back pressure hole is not closed is the angle at which the wrap of the fixed scroll does not close the back pressure hole of the movable scroll when the rotor is stopped, and the angle at which the discharge hole is not closed is the angle at which the wrap of the movable scroll does not close the discharge hole of the fixed scroll when the rotor is stopped, as described above.

DESCRIPTION OF EMBODIMENTS

Figure 1:
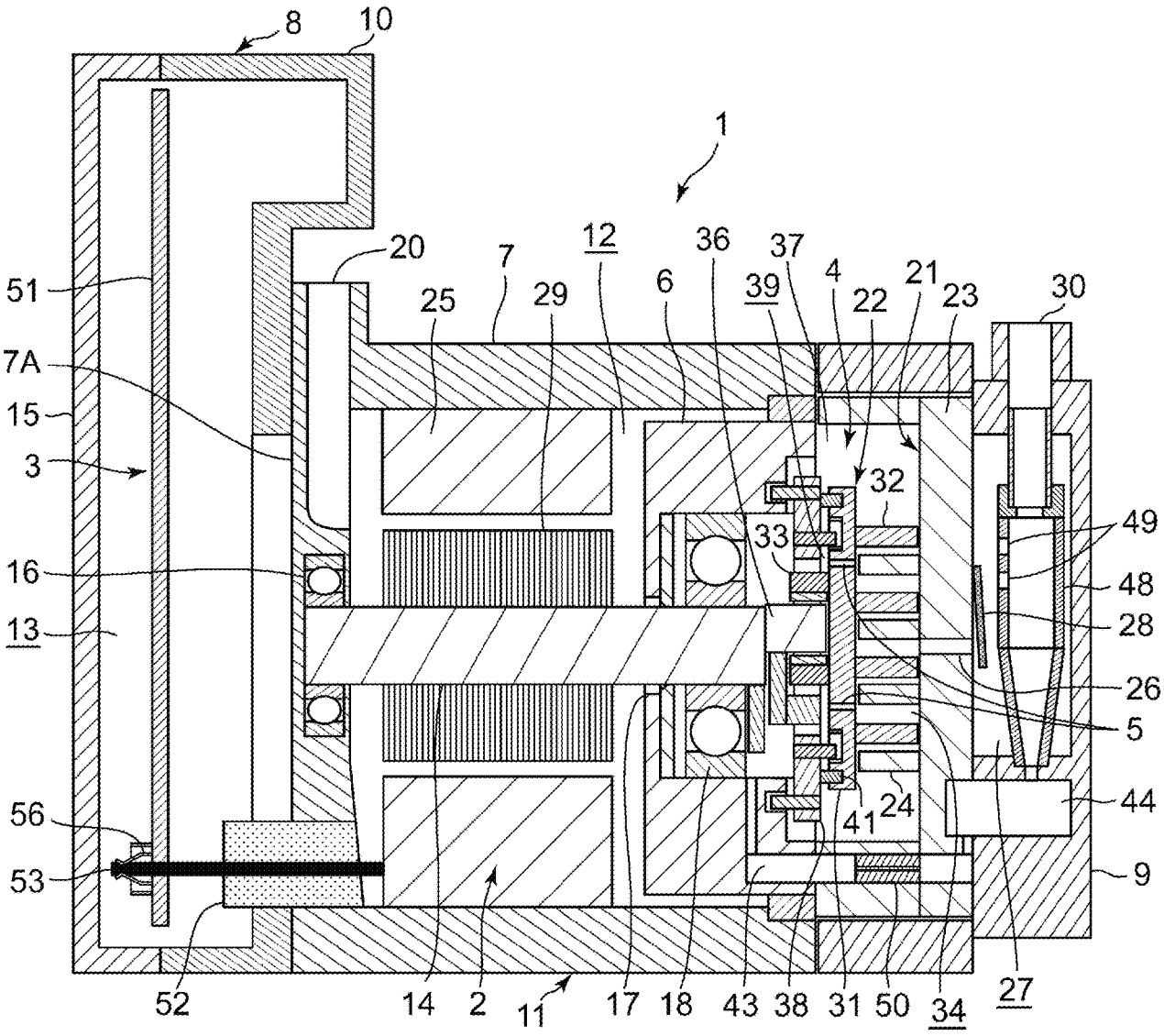
FIG. 1 is a longitudinal sectional side view of a scroll-type electric compressor of an embodiment to which the present invention is applied.

Hereinafter, embodiments of the present invention will be described in detail with reference to the drawings. FIG. 1 is a longitudinal sectional side view of a scroll-type electric compressor 1 of an embodiment to which the present invention is applied.

(1) Scroll-Type Electric Compressor 1

The scroll-type electric compressor 1 of the embodiment is used, for example, in a refrigerant circuit of an air-conditioning device for an electric vehicle, and sucks and compresses refrigerant as working fluid for the air-conditioning device, and discharges the refrigerant into a discharge pipe. The scroll-type electric compressor 1 is what is called a horizontal inverter-integrated scroll-type electric compressor including a three-phase motor 2, an inverter device 3 for driving (operating) the motor 2, and a scroll compression mechanism 4 driven by the motor 2.

The scroll-type electric compressor 1 of the embodiment includes a stator housing 7 accommodating the motor 2 and a center casing 6 therein, an inverter case 8 attached to a one-end-side end wall 7A of the stator housing 7 and accommodating the inverter device 3 therein, and a rear casing 9 attached to the other end side of the stator housing 7.

The stator housing 7, the inverter case 8, and the rear casing 9 are all made of metal (aluminum in the embodiment), and are integrally joined to form a housing 11 of the scroll-type electric compressor 1 of the embodiment.

A motor chamber 12 accommodating the motor 2 is formed in the stator housing 7, and one end face of the motor chamber 12 is basically closed with the end wall 7A of the stator housing 7. The end wall 7A serves as a partition wall defining the motor chamber 12 and an inverter accommodation portion 13 to be described later. The other end face of the motor chamber 12 is opened, and the center casing 6 is accommodated in the opening after the motor 2 has been accommodated. Moreover, a secondary bearing 16 for rotatably supporting one end portion of a drive shaft 14 of the motor 2 is attached on the inner face (motor chamber 12 side) of the end wall 7A.

The center casing 6 is opened on a side (other end side) opposite to the motor 2. After a movable scroll 22, which will be described below, of the scroll compression mechanism 4 has been accommodated, the rear casing 9 to which a fixed scroll 21, which will also be described below, of the scroll compression mechanism 4 is fixed is fixed to the stator housing 7 to thereby close the opening.

Moreover, a through-hole 17 into which the other end portion of the drive shaft 14 of the motor 2 is inserted is opened in the center casing 6, and a main bearing 18 rotatably supporting the other end portion of the drive shaft 14 on the scroll compression mechanism 4 side is attached on the scroll compression mechanism 4 side of the through-hole 17 in the center casing 6.

The motor 2 includes a stator 25 around which a coil is wound and which is fixed to the inside of a peripheral wall of the stator housing 7, and a rotor 29 which rotates inside the stator 25. In addition, it is configured in such a manner that, for example, DC voltage from a battery (FIG. 2) of the vehicle is converted into three-phase AC voltage by the inverter device 3 to be supplied to the coil of the stator 25 of the motor 2 and the rotor 29 is rotationally driven accordingly. In addition, the drive shaft 14 is fixed to the rotor 29.

Moreover, a suction port 20 is formed in the stator housing 7, and refrigerant sucked through the suction port 20 passes through the motor 2 in the stator housing 7, then flows into the center casing 6, and is sucked into a suction portion 37 outside the scroll compression mechanism 4. As a result, the motor 2 is cooled by the sucked refrigerant. Moreover, it is configured in such a manner that the refrigerant compressed by the scroll compression mechanism 4 is discharged from a discharge chamber 27 to be described below into the discharge pipe of the refrigerant circuit (not shown) outside the housing 11 through a discharge port 30 formed in the rear casing 9.

The scroll compression mechanism 4 includes the above-described fixed scroll 21 and movable scroll 22. The fixed scroll 21 integrally includes a disk-shaped end plate 23, and a wrap 24 erected on a face (one face) of the end plate 23, the wrap 24 having an involute shape or a spiral shape formed of a curve close to the involute shape, and being fixed to the rear casing 9 with the face, on which the wrap 24 is erected, of the end plate 23 facing the center casing 6.

In the center of the spiral end plate 23 of the fixed scroll 21, a discharge hole 26 is formed, and the discharge hole 26 communicates with the discharge chamber 27 in the rear casing 9. That is, the discharge hole 26 causes the discharge chamber 27 formed on the back face (other face) side of the end plate 23 of the fixed scroll 21 and a compression chamber 34 to communicate with each other. In the drawing, reference numeral 28 denotes a discharge valve provided at the opening of the discharge hole 26 on the back face (other face) side of the end plate 23.

The movable scroll 22 is a scroll that revolves relative to the fixed scroll 21, and integrally includes a disk-shaped end plate 31, a wrap 32 erected on a face (one face) of the end plate 31, the wrap 32 having an involute shape or a spiral shape formed of a curve close to the involute shape, and a boss 33 protruding from the center of the back face (other face) side of the end plate 31.

The movable scroll 22 is disposed in such a manner that the wrap 32 faces and meshes with the wrap 24 of the fixed scroll 21 with the protruding direction of the wrap 32 facing the fixed scroll 21, and the compression chamber 34 is formed between the wraps 24, 32.

That is, the wrap 32 of the movable scroll 22 faces the wrap 24 of the fixed scroll 21, and meshes with the wrap 24 of the fixed scroll 21 in such a manner that the distal end of the wrap 32 is in contact with the face of the end plate 23 and the distal end of the wrap 24 is in contact with the face of the end plate 31, and an eccentric portion 36 provided at the other end of the drive shaft 14 so as to be eccentric to the axis is fitted in the boss 33 of the movable scroll 22. In addition, it is configured in such a manner that when the drive shaft 14 is rotated together with the rotor 29 of the motor 2, then the movable scroll 22 revolves relative to the fixed scroll 21 without rotating on its axis.

Since the movable scroll 22 eccentrically revolves relative to the fixed scroll 21, the eccentric direction and contact position of each of the wraps 24, 32 move during rotation, and the compression chamber 34 having sucked the refrigerant from the above-described suction portion 37 on the outside is gradually narrowed while moving inward. As a result, the refrigerant is compressed and finally discharged from the central discharge hole 26 to the discharge chamber 27 through the discharge valve 28.

In FIG. 1, reference numeral 38 denotes an annular thrust plate. The thrust plate 38 divides a back pressure chamber 39 formed between the back face side of the end plate 31 of the movable scroll 22 and the center casing 6 and the suction portion 37 outside the scroll compression mechanism 4, and is located outside the boss 33 and interposed between the center casing 6 and the movable scroll 22. Moreover, reference numeral 41 denotes a sealing member attached to the back face side of the end plate 31 of the movable scroll 22 and contacting the thrust plate 38. The sealing member 41 and the thrust plate 38 divide the back pressure chamber 39 and the suction portion 37.

Moreover, reference numeral 48 denotes a centrifugal oil separator attached in the discharge chamber 27 of the rear casing 9 (housing 11). The oil separator 48 separates lubricating oil mixed in the refrigerant discharged from the scroll compression mechanism 4 into the discharge chamber 27, from the refrigerant. The oil separator 48 is formed with an inflow port 49, and the refrigerant containing the oil, which has flowed in through the inflow port 49, swirls in the oil separator 48. The oil is separated by the centrifugal force at this time, and the refrigerant flows from an outflow port at the upper end toward the discharge port 30, and is discharged into the discharge pipe as described above.

The rear casing 9 is formed with an oil reservoir 44 below the oil separator 48, and the oil separated from the refrigerant by the oil separator 48 flows into the oil reservoir 44 from the lower end of the oil separator 48. In the drawing, reference numeral 43 denotes a back pressure passage formed from the rear casing 9 to the center casing 6. The back pressure passage 43 is a path which causes the oil separator 48 in the discharge chamber 27 (discharge side of the scroll compression mechanism 4) in the rear casing 9 to communicate with the back pressure chamber 39, and has an orifice 50 in the embodiment. As a result, the back pressure chamber 39 is configured in such a manner that discharge pressure adjusted and reduced by the orifice 50 of the back pressure passage 43 is supplied to the back pressure chamber 39 together with the oil in the oil reservoir 44, which has been separated by the oil separator 48.

The pressure (back pressure) in the back pressure chamber 39 generates a back pressure load which presses the movable scroll 22 against the fixed scroll 21. Under the back pressure load, the movable scroll 22 is pressed against the fixed scroll 21 against compression reaction force from the compression chamber 34 of the scroll compression mechanism 4, the contact between the wraps 24, 32 and the end plates 31, 23 is maintained, and the refrigerant can be compressed in the compression chamber 34.

The end plate 31 of the movable scroll 22 is provided with back pressure holes 5 causing the back pressure chamber 39 and the compression chamber 34 to communicate with each other at two locations in the embodiment. Each back pressure hole 5 plays a role of releasing pressure (refrigerant and oil) from the back pressure chamber 39 to the compression chamber 34 when the pressure (back pressure) in the back pressure chamber 39 becomes excessive.

On the other hand, the inverter case 8 includes a case body 10 forming the inverter accommodation portion 13 in which the inverter device 3 is accommodated, and a lid member 15 closing an opening of one end face of the case body 10. The lid member 15 is attached to the case body 10 after the inverter device 3 has been accommodated in the inverter accommodation portion 13.

A hermetic plate 52 is attached to the end wall 7A (partition wall) of the stator housing 7, and a conductive hermetic pin 53 is attached to the hermetic plate 52. One end side of the hermetic pin 53 penetrates the end wall 7A into the motor chamber 12, and is connected to the coil of the stator 25 of the motor 2. The other end side of the hermetic pin 53 is electrically connected to a circuit board 51 of the inverter device 3 through a press-fit terminal 56.

(2) Inverter Device 3

Figure 2:
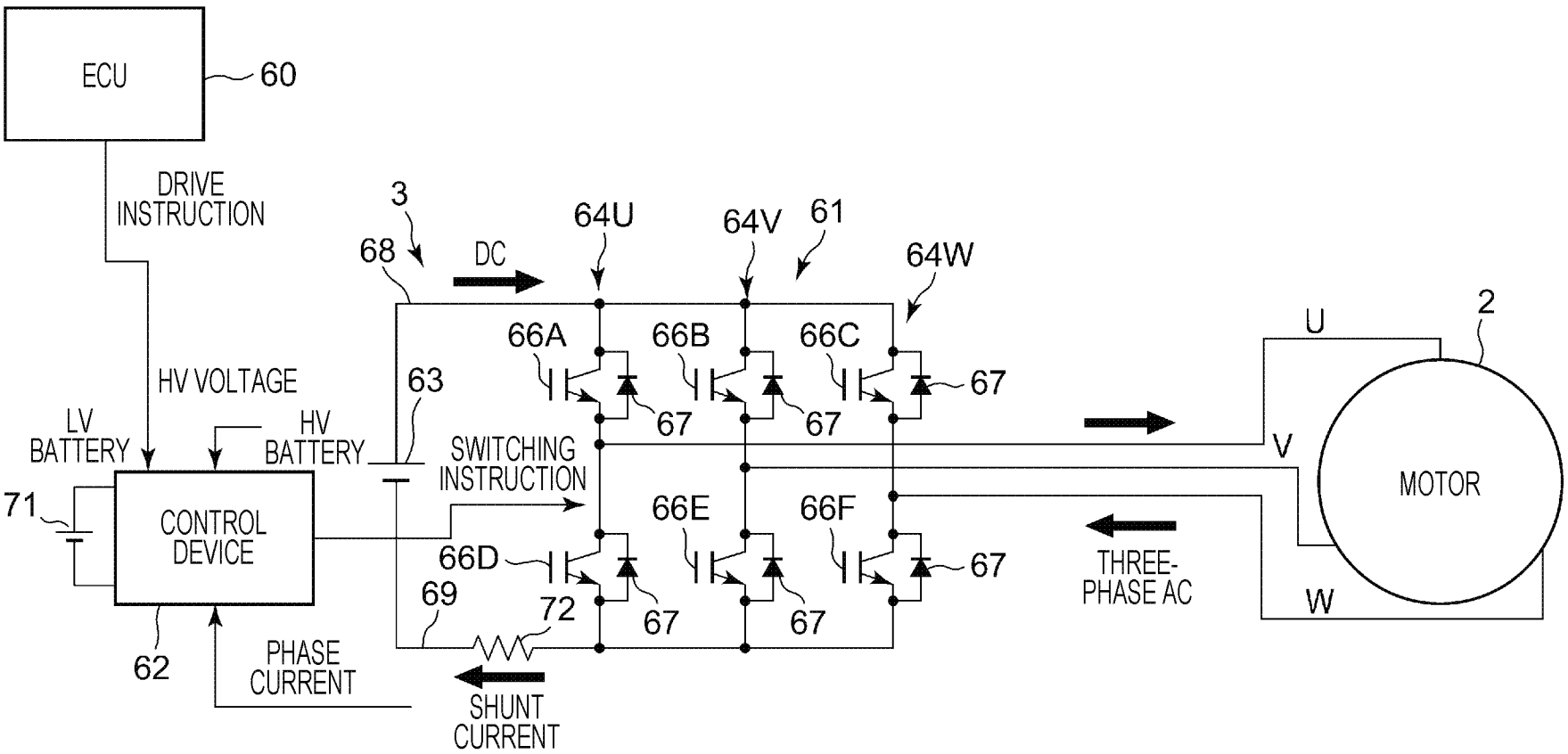
FIG. 2 is an electric circuit diagram of the scroll-type electric compressor of FIG. 1.

Next, FIG. 2 shows an electric circuit of the scroll-type electric compressor 1 including the motor 2 and the inverter device 3 described above. The inverter device 3 of the embodiment includes a three-phase inverter circuit 61 and a control device 62. The inverter circuit 61 is a circuit that converts the DC voltage of a DC power supply (HV battery of the vehicle: for example, an HV voltage of 300 V) 63 into three-phase AC voltage and applies the three-phase AC voltage to the motor 2.

The inverter circuit 61 has a U-phase half bridge circuit 64U, a V-phase half bridge circuit 64V, and a W-phase half bridge circuit 64W. The half bridge circuits 64U to 64W of the phases individually have upper arm switching elements 66A to 66C and lower arm switching elements 66D to 66F. Further, a flywheel diode 67 is connected in anti-parallel to each of the switching elements 66A to 66F. Note that each of the switching elements 66A to 66F includes an insulated-gate bipolar transistor (IGBT) or the like in which a MOS structure is incorporated in a gate portion in the embodiment.

The upper end sides of the upper arm switching elements 66A to 66C of the inverter circuit 61 are connected to an upper arm power supply line (positive bus bar) 68 of the DC power supply 63. On the other hand, the lower end sides of the lower arm switching elements 66D to 66F of the inverter circuit 61 are connected to a lower arm power supply line (negative bus bar) 69 of the DC power supply 63.

In this case, the upper arm switching element 66A and lower arm switching element 66D of the U-phase half bridge circuit 64U are connected in series, the upper arm switching element 66B and lower arm switching element 66E of the V-phase half bridge circuit 64V are connected in series, and the upper arm switching element 66C and lower arm switching element 66F of the W-phase half bridge circuit 64W are connected in series.

A connection point between the upper arm switching element 66A and lower arm switching element 66D of the U-phase half bridge circuit 64U is connected to the U-phase armature coil of the motor 2, a connection point between the upper arm switching element 66B and lower arm switching element 66E of the V-phase half bridge circuit 64V is connected to the V-phase armature coil of the motor 2, and a connection point between the upper arm switching element 66C and lower arm switching element 66F of the W-phase half bridge circuit 64W is connected to the W-phase armature coil of the motor 2.

Note that reference numeral 71 in the drawing denotes a low-voltage power supply (LV battery of the vehicle: for example, an LV voltage of 12 V), which is a power supply for the control device 62. Moreover, reference numeral 72 denotes a current sensor (for example, shunt resistor), and the current sensor 72 is connected to the lower arm power line 69 and used to detect the phase current of the motor 2.

The control device 62 includes a microcomputer having a processor, and a drive instruction such as a rotation speed command value or a stop instruction is input to the control device 62 from an ECU 60 which is the above-described system of the electric vehicle. That is, the control device 62 receives the rotation speed command value from the ECU 60, receives the phase current of the motor 2 based on the current sensor 72, and outputs a switching instruction to each of the switching elements 66A to 66F of the inverter circuit 61 based on the command value and the phase current to control ON/OFF of these elements. Specifically, the control device 62 controls gate voltage to be applied to the gate electrode of each of the switching elements 66A to 66F.

The control device 62 detects the current value (shunt current value) of the lower arm power line 69 by the current sensor 72, and calculates and estimates the phase currents of the U-, V-, and W-phases from the current value and the operation state of the motor 2. Then, the control device 62 of the embodiment switches the switching elements 66A to 66F of the inverter circuit 61 by sensorless vector control for estimating the position (angle θ) of the rotor 29 based on the current command value obtained from the rotation speed command value of the motor 2 and the estimated phase current, and applies the phase voltage to the armature coils of the U-, V-, and W-phases of the motor 2, thereby rotationally driving the rotor 29 and driving the movable scroll 22 of the scroll compression mechanism 4. Note that the angle θ is, for example, an angle from an electrical angle of zero in this application.

(3) Deceleration Control and Brake Control of Motor 2 by Control Device 62

Next, deceleration control and brake control when the motor 2 is stopped by the control device 62 will be described with reference to FIGS. 3 to 6. Note that in this embodiment, the deceleration control of the motor 2 includes sensorless deceleration control and forced commutation deceleration control to be described later.

Figure 3:
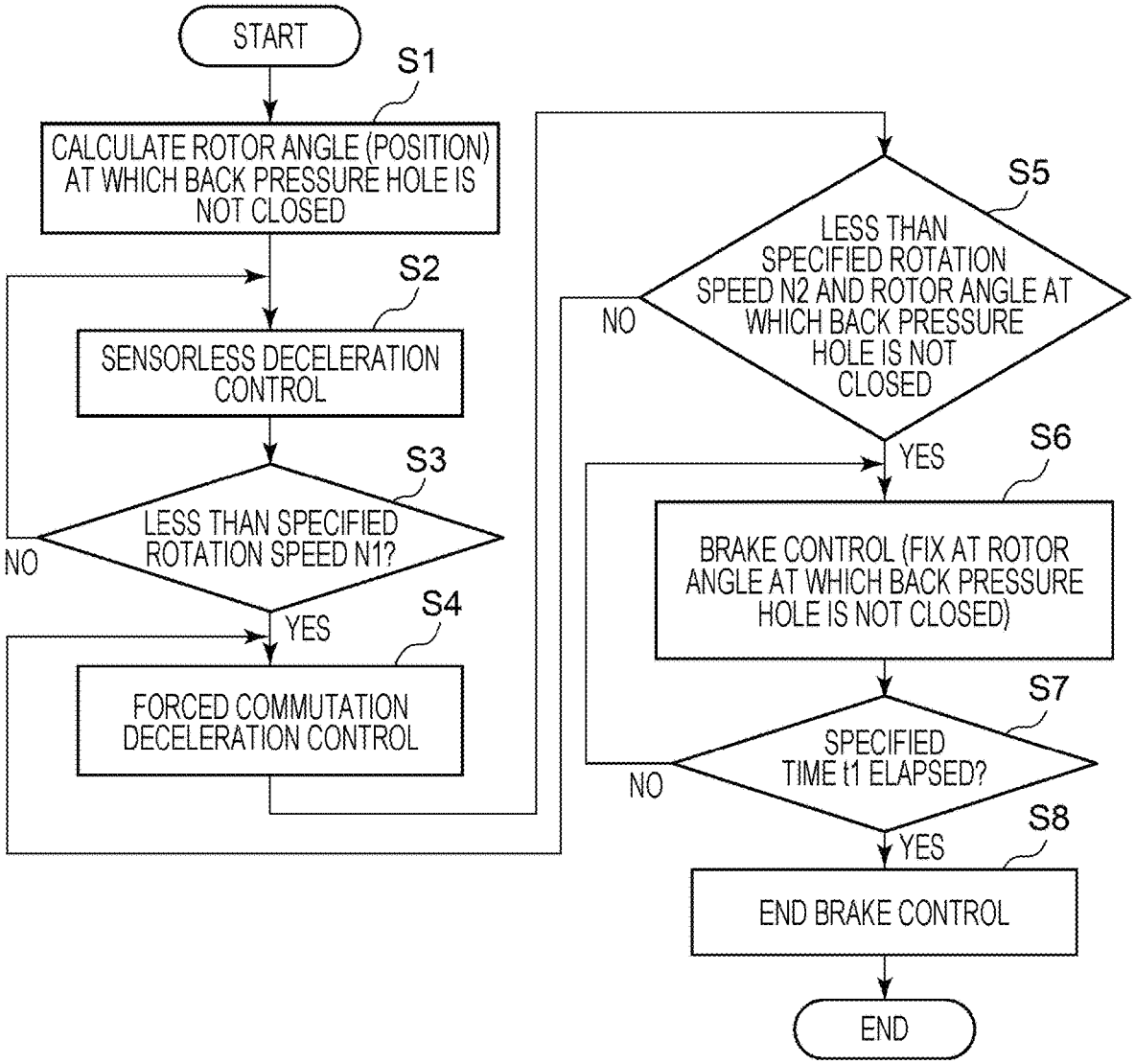
FIG. 3 is a flowchart for describing sensorless deceleration control, forced commutation deceleration control, and brake control executed by a control device of FIG. 2.

That is, in this embodiment, when receiving the instruction to stop the motor 2 from the ECU 60 of the electric vehicle, the control device 62 first calculates the angle θ1 of the rotor 29 (the position of the rotor 29) at which the wrap 24 of the fixed scroll 21 does not close the back pressure hole 5 of the movable scroll 22 in Step S1 of FIG. 3.

Figure 5:
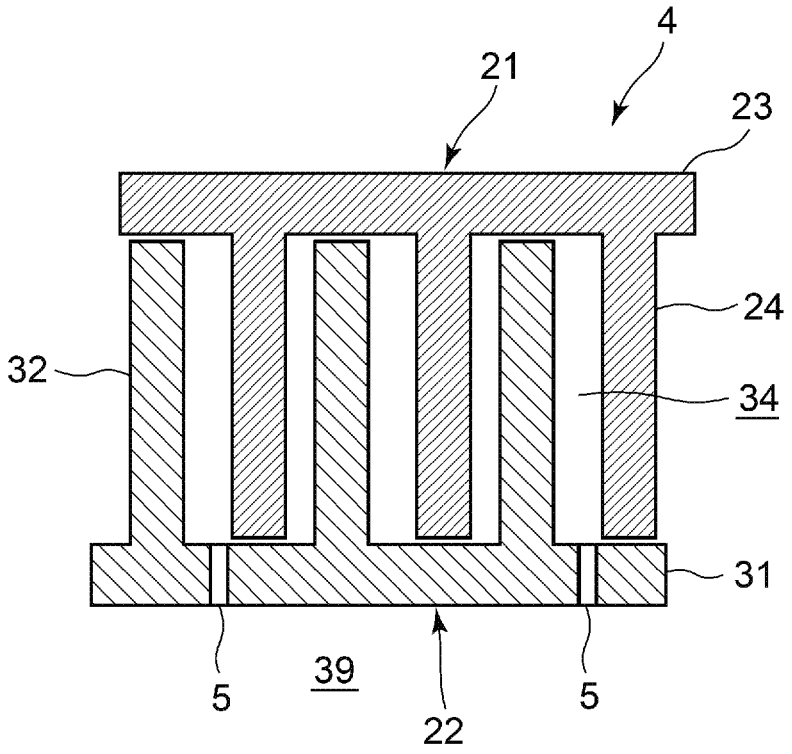
FIG. 5 is an enlarged sectional view of a movable scroll and a fixed scroll in a state in which a back pressure hole of FIG. 1 is not closed.

FIG. 5 shows a state in which the back pressure hole 5 is not closed. In this state, the two back pressure holes 5 of the movable scroll 22 are shifted from the wrap 24 of the fixed scroll 21, and the back pressure holes 5 are not closed by the wrap 24 of the fixed scroll 21, but are opened (fully opened) to cause the compression chamber 34 with an intermediate pressure to communicate with the back pressure chamber 39. The control device 62 calculates the angle θ1 of the rotor 29 at which the movable scroll 22 is at the position of FIG. 5 (position at which the back pressure holes 5 are not closed).

A method of calculating the angle θ1 of the rotor 29 at which the back pressure holes 5 are not closed is as follows.

Figure 6:
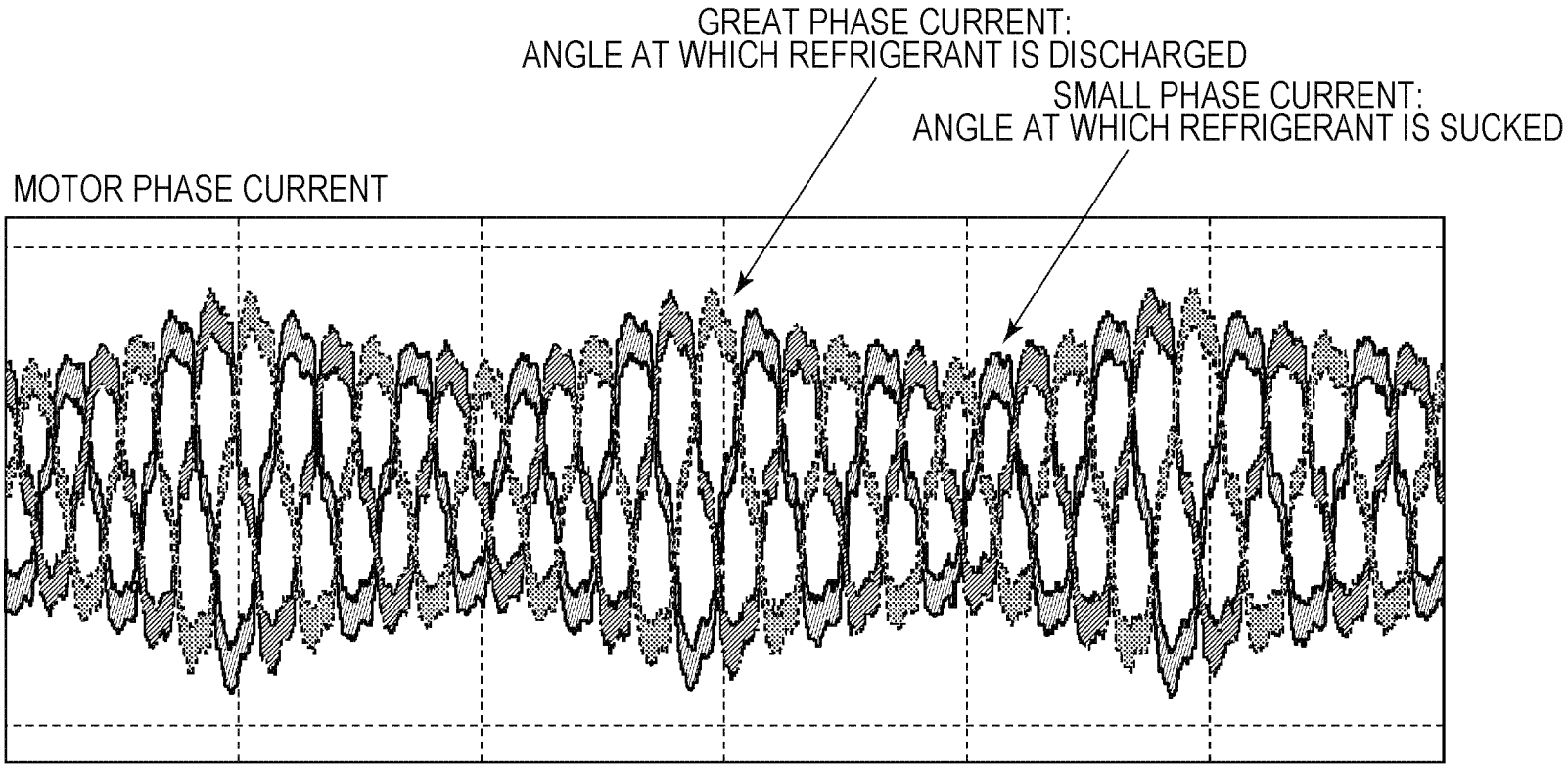
FIG. 6 is a graph showing a change in the amplitude of the phase current of the motor due to torque pulsation.
Figure 7:
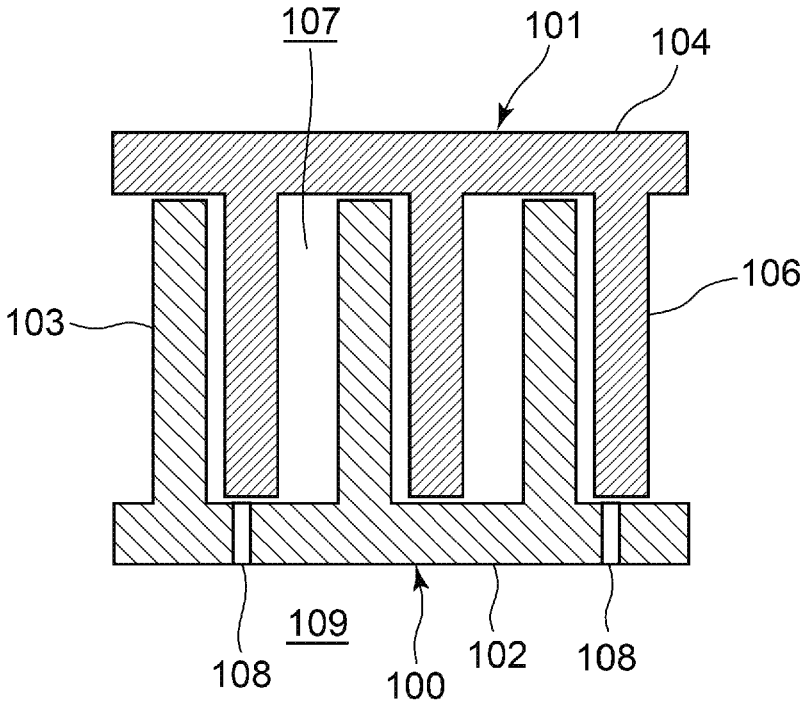
FIG. 7 is a sectional view of the movable scroll and the fixed scroll in a state in which the back pressure hole is closed.

(i) Calculation Based on Change in Amplitude of Phase Current Due to Torque Pulsation FIG. 6 shows a change in the amplitude of the phase current of the motor 2 due to torque pulsation generated along with the compression operation of the scroll compression mechanism 4. As shown in this figure, the amplitude of the phase current is maximized at an angle at which the refrigerant is discharged (the discharge valve 28 is opened), and the amplitude of the phase current is minimized at an angle at which the refrigerant is sucked (the discharge valve 28 is closed).

A correlation between the angle θ1 of the rotor 29 at which the back pressure holes 5 are not closed and the change in the amplitude of the phase current due to the torque pulsation (an example of a correlation between the phase current and the angle at which the back pressure hole is not closed) is obtained in advance by an experiment and stored in the control device 62. Then, the control device 62 calculates the angle θ1 of the rotor 29 based on the change in the amplitude of the phase current.

(ii) Calculation Based on Maximum and Minimum Values of Phase Current

Alternatively, the angle may be calculated based on a correlation between an angle at which the amplitude of the phase current as described above is maximized/minimized and the angle θ1 of the rotor 29 at which the back pressure holes 5 are not closed (another example of the correlation between the phase current and the angle at which the back pressure hole is not closed).

(iii) Calculation Based on Peak Value and Filter Value of Phase Current

Figure 8:
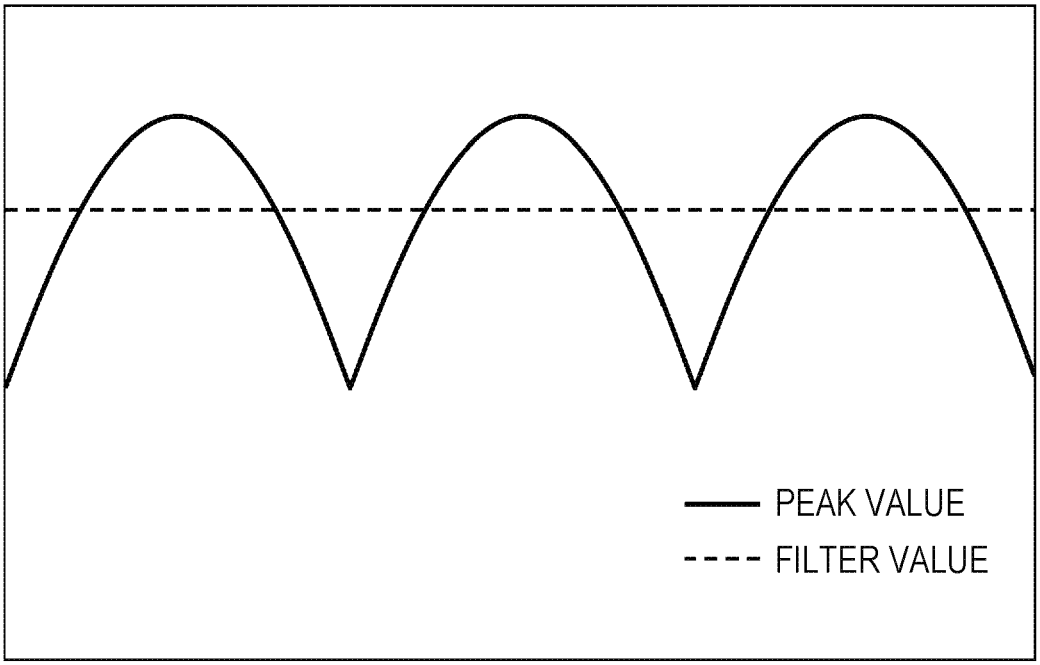
FIG. 8 is a graph showing a peak value and a filter value of the phase current.

Alternatively, the angle may be calculated based on a correlation between an angle at which phase current information and filtered delayed phase current information intersect and the angle θ1 of the rotor 29 at which the back pressure holes 5 are not closed (another example of the correlation between the phase current and the angle at which the back pressure hole is not closed). In this case, as shown in FIG. 8, the correlation between the angle at which the peak value of the phase current (phase current information) and a filter value obtained by filtering the phase current (filtered delayed phase current information) intersect and the angle θ1 of the rotor 29 at which the back pressure holes 5 are not closed is stored in advance in the control device 62.

(3-1) Sensorless Deceleration Control

Figure 4:
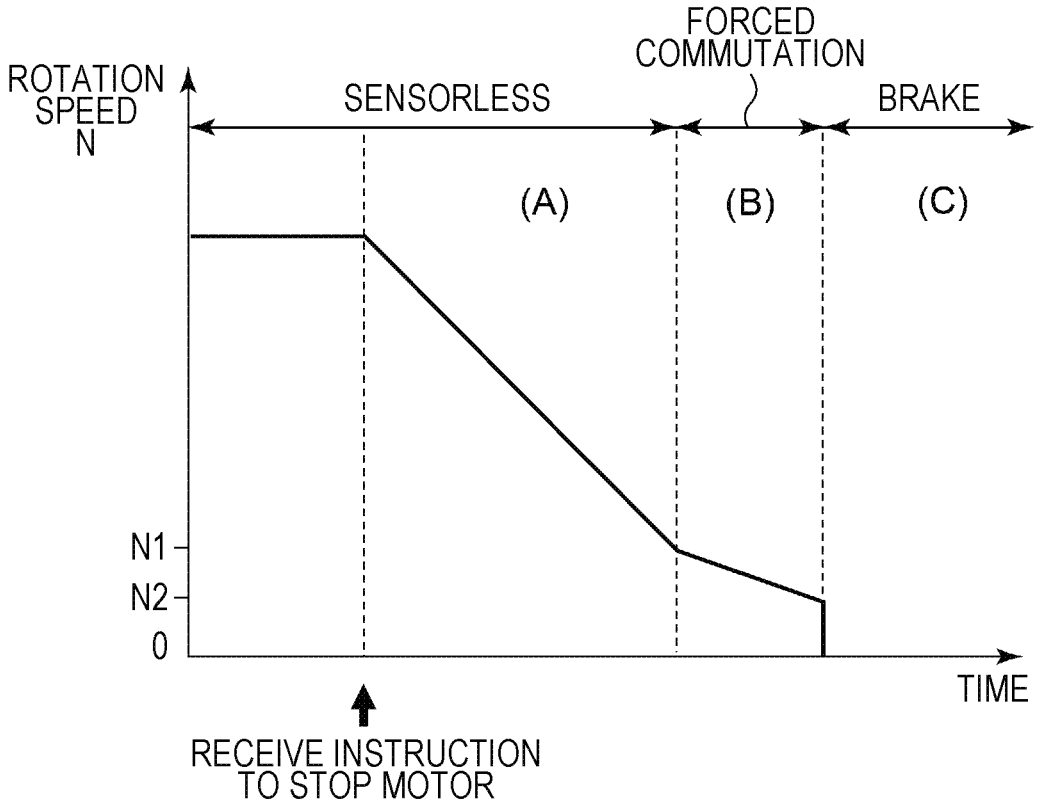
FIG. 4 is a graph for describing a change in the rotation speed of a motor in the sensorless deceleration control, the forced commutation deceleration control, and brake control executed by the control device of FIG. 2.

Next, the control device 62 executes the sensorless deceleration control in Step S2. FIG. 4 shows a change in the rotation speed N of the motor 2. As described above, the control device 62 controls the rotation speed N of the motor 2 by the sensorless vector control during a normal operation, but executes the sensorless deceleration control of decreasing the rotation speed N of the motor 2 by switching the switching elements 66A to 66F by the sensorless vector control from the time point when the instruction to stop the motor 2 is received from the ECU 60 of the electric vehicle (range (A) in FIG. 4). In this sensorless deceleration control, the rotation speed N may be continuously decreased at a predetermined decrease rate, or may be decreased in a stepwise manner, that is, by repeating deceleration and holding (not decreasing the rotation speed N).

Next, in Step S3 of FIG. 3, the control device 62 determines whether or not the rotation speed N of the motor 2 reaches less than a specified rotation speed N1, which is a predetermined small value. If the rotation speed N is not less than the specified rotation speed N1, the processing returns to Step S2, and is repeated. Here, when the rotation speed N of the motor 2 decreases by the sensorless deceleration control as described above, the position (angle θ) of the rotor 29 cannot be estimated eventually.

(3-2) Forced Commutation Deceleration Control

Thus, when the rotation speed N of the motor 2 decreases by the above-described sensorless deceleration control and reaches less than the specified rotation speed N1 (after having reached less than the specified rotation speed N1), the control device 62 proceeds the processing to Step S4 and executes the forced commutation deceleration control (range (B) of FIG. 4). In the forced commutation deceleration control, the control device 62 decreases the rotation speed N of the motor 2 by feedforward forced commutation control of determining the rotation speed and forcibly switching the switching elements 66A to 66F.

In the forced commutation deceleration control, the rotation speed N may be continuously decreased to a specified rotation speed N2 to be described later at a predetermined decrease rate, or the rotation speed N2 may be held for a certain period after the rotation speed N has been decreased to the specified rotation speed N2.

Next, in Step S5 of FIG. 3, the control device 62 determines whether or not the rotation speed N of the motor 2 reaches less than the specified rotation speed N2 (predetermined low value) which is a value smaller than the above-described specified rotation speed N1 and is a value before reaching zero and the angle θ of the rotor 29 reaches the angle θ1 at which the back pressure holes 5 are not closed, which has been calculated in Step S1, and if not, the processing returns to Step S4 and is repeated.

Since the rotation speed N of the motor 2 is subjected to the forced commutation control, the control device 62 grasps such a rotation speed by itself. The angle θ of the rotor 29 can be grasped by adding the angle of the rotor 29 which can be grasped by the forced commutation control to the position (angle) of the rotor 29 estimated by the above-described sensorless vector control.

In addition, since the phase current of the motor 2 is detected in the sensorless deceleration control of the range (A) of FIG. 4, in this embodiment, the control device 62 controls the value of the phase current in the forced commutation deceleration control to a required appropriate value based on the phase current in the sensorless deceleration control. That is, the control device 62 estimates the torque from the value of the phase current in the sensorless deceleration control, and decreases the value of the phase current in the forced commutation deceleration control when the torque is small and increases the value of the phase current when the torque is large.

(3-3) Brake Control

By the forced commutation deceleration control as described above, when the rotation speed N of the motor 2 reaches less than the specified rotation speed N2 and the angle θ of the rotor 29 reaches the angle θ1, that is, when the angle θ of the rotor 29 reaches the angle θ1 after the rotation speed N has reached less than the specified rotation speed N2, the control device 62 proceeds the processing from Step S5 to Step S6, and executes the brake control to fix the angle θ of the rotor 29 to the angle θ1.

In this brake control, the control device 62 executes electromagnetic braking for turning on each of the switching elements 66A to 66F at a target angle and a duty ratio at which a target output voltage is obtained, thereby fixing the angle θ of the rotor 29 to the angle θ1 at which the back pressure holes 5 are not closed while causing current to flow through the motor 2 (range (C) in FIG. 4). In this case, the control device 62 performs feedback control of the value of the phase current of the motor 2 by electromagnetic braking. When a plurality of compression chambers 34, a single back pressure hole 5, or a set of back pressure holes 5 is provided, the angle θ1 may be changed a predetermined number of times.

In this embodiment, also in this brake control, the control device 62 controls the value of the phase current to a required appropriate value based on the phase current in the sensorless deceleration control. That is, the control device 62 estimates the torque from the value of the phase current in the sensorless deceleration control, and decreases the value of the phase current in the brake control when the torque is small and increases the value of the phase current when the torque is large.

Since the angle θ of the rotor 29 of the motor 2 is fixed to the angle θ1 by such brake control, the pressure (refrigerant and oil) in the compression chamber 34 of the scroll compression mechanism 4 releases to the back pressure chamber 39 through the back pressure hole 5. Accordingly, reverse rotation of the scroll compression mechanism 4 is avoided.

Next, in Step S7, the control device 62 determines whether or not a predetermined specified time t1 has elapsed from the start of the brake control. If not, the processing returns to Step S6 to continue the brake control. When the specified time t1 has elapsed from the start of the brake control, the control device 62 proceeds the processing to Step S8 to end the brake control, and turns off all the switching elements 66A to 66F.

As described in detail above, according to the present invention, the control device 62 executes the deceleration control of switching the switching elements 66A to 66F to decrease the rotation speed N of the motor 2 after having received the instruction to stop the motor 2, and the brake control of stopping the rotor 29 of the motor 2 at the angle θ1 at which the back pressure hole of the movable scroll 22 is not closed after the rotation speed N of the motor 2 has been decreased by the deceleration control and switching the switching elements 66A to 66F to be fixed at the angle θ1. Therefore, when the motor 2 is stopped, the rotor 29 is fixed at the angle θ1 at which the back pressure hole 5 of the movable scroll 22 is not closed by the wrap 24 of the fixed scroll 21.

As a result, the pressure inside the scroll compression mechanism 4 can be promptly released and decreased through the back pressure hole 5 of the movable scroll 22. Thus, since the time for executing the brake control can also be shortened, it is possible to effectively prevent the reverse rotation of the movable scroll 22 and reduce noise generated from the scroll compression mechanism 4 while minimizing failure and life shortening due to heat generation from the switching elements 66A to 66F.

In this case, in the embodiment, the control device 62 executes, as the deceleration control, the sensorless deceleration control of decreasing the rotation speed N of the motor 2 by the sensorless vector control after having received the instruction to stop the motor 2, and the forced commutation deceleration control of decreasing the rotation speed N of the motor 2 to the predetermined low value by the forced commutation control after the rotation speed N of the motor 2 has been decreased by the sensorless deceleration control. Thus, the rotation speed N of the motor 2 can be promptly decreased by the sensorless deceleration control, and the rotation speed N of the motor 2 can be forcibly decreased by the forced commutation deceleration control in the range in which it is difficult to detect the position.

In addition, in the embodiment, the control device 62 controls the value of the phase current in the forced commutation deceleration control and the brake control based on the phase current in the sensorless deceleration control. Thus, when the value of the phase current in the sensorless deceleration control is small as described above, the value of the phase current in the forced commutation deceleration control and the brake control is also decreased accordingly, so that the forced commutation deceleration control and the brake control can be executed stably and efficiently.

Further, in the embodiment, since the control device 62 executes the brake control before the rotation speed N of the motor 2 reaches zero, the angle θ at which the rotor 29 is stopped and fixed can be accurately and easily adjusted to the angle θ1 at which the back pressure hole 5 of the movable scroll 22 is not closed. At that time, in the embodiment, since the value of the phase current of the motor 2 is feedback-controlled by electromagnetic braking, it is possible to prevent the phase current from excessively jumping up due to regenerative current which is concerned in power generation braking and to avoid inconvenience leading to occurrence of failure of the switching element or the like in advance.

Note that in the embodiment, the control device 62 calculates the angle θ1 at which the back pressure hole 5 is not closed in Step S1, and detects whether or not the angle of the rotor 29 has reached the calculated angle θ1 in Step S5. However, the angle θ1 may be detected in Step S5 as follows without calculation.

(A) Detection Based on Predetermined Angle of Rotor 29

The angle θ1 of the rotor 29 at which the back pressure hole 5 is not closed is obtained in advance by an experiment and stored in the control device 62. Then, when the angle θ obtained by adding the position of the rotor 29 which can be grasped by the forced commutation control to be described later to the position of the rotor 29 estimated by the sensorless vector control described above reaches the angle θ1, it is detected that the angle of the rotor 29 has reached the angle θ1.

(B) Detection by Sensor That Detects Angle θ (Position) of Rotor 29

The angle θ1 of the rotor 29 at which the back pressure hole 5 is not closed is obtained in advance by an experiment and stored in the control device 62. Further, a position detection sensor for the rotor 29 is provided, and the angle θ1 of the rotor 29 at which the back pressure hole 5 is not closed is detected based on the output of the sensor.

In Step S5, the control device 62 may calculate the angle θ1 in Step S1 and detect whether or not the angle θ of the rotor 29 has reached the angle θ1 as described above, may detect the angle θ1 by any of the methods (A) and (B) above, or may detect whether or not the angle θ of the rotor 29 has reached the angle θ1 by a combination thereof.

In the embodiment, the control device 62 stops and fixes the rotor 29 at the angle θ1 at which the back pressure hole 5 is not closed. However, when the discharge valve 28 for setting the clearance of the discharge hole 26 is used, an angle at which the discharge hole 26 at the center of the spiral end plate 23 of the fixed scroll 21 is not closed by the wrap 32 of the movable scroll 22 may be set as θ1, and the rotor 29 may be stopped and fixed at the angle θ1. As a result, the pressure inside the scroll compression mechanism 4 can be promptly released and decreased through the discharge hole 28.

Further, in the embodiment, in the deceleration control, the control device 62 executes the sensorless deceleration control and the forced commutation deceleration control, but in the invention of claim 1, the entirety of the deceleration control may be the forced commutation deceleration control. Furthermore, in the embodiment, the sensorless deceleration control is switched to the forced commutation deceleration control at the specified rotation speed N1, but the present invention is not limited thereto. The sensorless deceleration control may be switched to the forced commutation deceleration control based on a change in the phase current such as an increase in the phase current due to difficulty in the sensorless vector control due to a decrease in the rotation speed N in the sensorless deceleration control.

In the embodiment, the forced commutation deceleration control is switched to the brake control based on the specified rotation speed N2, but the present invention is not limited thereto. The forced commutation deceleration control may be switched to the brake control based on the residual pressure of the scroll compression mechanism 4. In this case, when the rotation speed N of the motor 2 decreases to the specified rotation speed N2, such a rotation speed is held. When the rotation speed is held at the specified rotation speed N2, the suction pressure of the scroll-type electric compressor 1 increases, so that the motor load torque due to the suction pressure increases. On the other hand, since the discharge pressure of the scroll-type electric compressor 1 decreases, the motor load torque due to the discharge pressure decreases. The residual pressure of the scroll compression mechanism 4 may be grasped using such a mechanism, and the forced commutation deceleration control may be shifted to the brake control. Pressure information at that time may be set from current to be distributed and applied voltage information, pressure sensor information may be acquired from the ECU 60 of the electric vehicle, or a sensor may be provided in the scroll-type electric compressor 1 itself and information from such a sensor may be used.

Further, in the embodiment, in both the forced commutation deceleration control and the brake control, the value of the phase current is changed based on the phase current in the sensorless deceleration control. However, the phase current may be changed only in one of the forced commutation deceleration control or the brake control.

In the embodiment, the value of the phase current in the forced commutation deceleration control and the brake control is changed based on the phase current in the sensorless deceleration control, but the present invention is not limited thereto. The value of the phase current in the forced commutation deceleration control and the brake control may be changed based on the pressure (residual pressure as described above) of the scroll compression mechanism 4. In this case, for example, when the residual pressure of the scroll compression mechanism 4 is small, the value of the phase current in the forced commutation deceleration control and the brake control are decreased accordingly.

In the embodiment, the present invention is applied to the scroll-type electric compressor 1 used in the refrigerant circuit of the air-conditioning device for the vehicle, but the present invention is not limited thereto. The present invention is effective for scroll-type electric compressors used in refrigerant circuits of various refrigeration devices. Further, in the embodiment, the present invention is applied to what is called the inverter-integrated scroll-type electric compressor, but the present invention is not limited thereto. The present invention can also be applied to a normal scroll-type electric compressor not integrally provided with an inverter.

LIST OF REFERENCE SIGNS

1 Scroll-Type Electric Compressor
2 Motor
3 Inverter Device
4 Scroll Compression Mechanism

5 Back Pressure Hole
21 Fixed Scroll
22 Movable Scroll
23, 31 End Plate
24, 32 Wrap
26 Discharge Hole
27 Discharge Chamber
29 Rotor
34 Compression Chamber
61 Inverter Circuit
62 Control Device
63 DC Power Supply
66A to 66F Switching Element
72 Current Sensor

The invention claimed is:

1. A scroll-type electric compressor comprising:

a scroll compression mechanism including a movable scroll having a back pressure hole and a fixed scroll to compress working fluid;

a motor that drives the movable scroll;

an inverter circuit including a plurality of switching elements to drive the motor; and a control device that switches the switching elements, wherein the control device executes deceleration control of switching the switching elements to decrease a rotation speed of the motor after having received an instruction to stop the motor, and brake control of stopping a rotor of the motor at an angle at which the back pressure hole of the movable scroll is not closed or an angle at which a discharge hole of the fixed scroll is not closed after the rotation speed of the motor has been decreased by the deceleration control and switching the switching elements to fix the rotor at the angle.

2. The scroll-type electric compressor according to claim 1, wherein the deceleration control executed by the control device includes sensorless deceleration control of decreasing the rotation speed of the motor by sensorless vector control after having received the instruction to stop the motor, and forced commutation deceleration control of decreasing the rotation speed of the motor to a predetermined low value by forced commutation control after the rotation speed of the motor has been decreased by the sensorless deceleration control.

3. The scroll-type electric compressor according to claim 2, wherein the control device controls a value of a phase current in the forced commutation deceleration control and/or the brake control based on a phase current in the sensorless deceleration control or a pressure of the scroll compression mechanism.

4. The scroll-type electric compressor according to claim 1, wherein the control device executes the brake control by electromagnetic braking before the rotation speed of the motor reaches zero, and feedback-controls a value of a phase current of the motor in the brake control.

5. The scroll-type electric compressor according to claim 1, wherein the control device detects the angle at which the back pressure hole or the discharge hole is not closed using at least one of a correlation between the phase current and the angle at which the back pressure hole or the discharge hole is not closed, a change in an amplitude of the phase current due to torque pulsation, a predetermined angle of the rotor, and a sensor that detects the angle of the rotor.

6. The scroll-type electric compressor according to claim 1, wherein the scroll compression mechanism includes the fixed scroll and the movable scroll in which spiral wraps are formed on respective faces of end plates so as to face each other, and compresses the working fluid by causing the movable scroll to revolve relative to the fixed scroll and moving a compression chamber formed between the wraps of the scrolls while narrowing the compression chamber from an outside to an inside, the discharge hole causes a discharge chamber on a back face side of the end plate of the fixed scroll and the compression chamber to communicate with each other, and the back pressure hole causes a back pressure chamber on a back face side of the end plate of the movable scroll and the compression chamber to communicate with each other, and the angle at which the back pressure hole is not closed is an angle at which the wrap of the fixed scroll does not close the back pressure hole of the movable scroll when the rotor is stopped, and the angle at which the discharge hole is not closed is an angle at which the wrap of the movable scroll does not close the discharge hole of the fixed scroll when the rotor is stopped.

* * * * *